United States Patent [19]

Teraoka et al.

[11] Patent Number: 4,574,195

[45] Date of Patent: Mar. 4, 1986

[54] RADIATION IMAGE STORAGE PANEL

[75] Inventors: Masanori Teraoka; Terumi Matsuda, both of Kaisei, Japan

[73] Assignee: Fuji Photo Film Company, Ltd., Kanagawa, Japan

[21] Appl. No.: 590,487

[22] Filed: Mar. 16, 1984

[30] Foreign Application Priority Data

Mar. 17, 1983 [JP] Japan ..... 58-45685

[51] Int. Cl.[4] ..... G03C 5/16

[52] U.S. Cl. ..... 250/327.2; 250/484.1

[58] Field of Search ..... 250/327.2, 484.1

[56] References Cited

U.S. PATENT DOCUMENTS 4,510,388 4/1985 Yamazaki et al. ..... 250/327.2

4,511,802 4/1985 Teraoka ..... 250/484.1

*Primary Examiner*—Janice A. Howell

*Attorney, Agent, or Firm*—Murray, Whisenhunt & Ferguson

[57] ABSTRACT

A radiation image storage panel comprising a support, a phosphor layer provided on the support which comprises a binder and a stimulable phosphor dispersed therein, and a protective film provided on the phosphor layer, characterized in that said support has a surface hardness lower than that of said protective film. Alternatively, the support can be provided with a plastic film layer having the surface hardness lower than that of the protective film.

7 Claims, 2 Drawing Figures

RADIATION IMAGE STORAGE PANEL

BACKGROUND OF THE INVENTION

1. Field of the Invention

The present invention relates to a radiation image storage panel, and more particularly, to a radiation image storage panel improved in the resistance to physical deterioration such as abrasion.

2. Description of the Prior Art

For obtaining a radiation image, there has been conventionally employed a radiography utilizing a combination of a radiographic film having an emulsion layer containing a photosensitive silver salt material and an intensifying screen.

As a method replacing the above-described radiography, a radiation image recording and reproducing method utilizing a stimulable phosphor as described, for example, in U.S. Pat. No. 4,239,968, has been recently paid much attention. In the radiation image recording and reproducing method, a radiation image storage panel comprising a stimulable phosphor (i.e., a stimulable phosphor sheet) is employed, and the method involves steps of causing the stimulable phosphor of the panel to absorb a radiation energy having passed through an object or having radiated from an object; exciting the stimulable phosphor, or scanning the panel, with an electromagnetic wave such as visible light and infrared rays (hereinafter referred to as "stimulating rays") to sequentially release the radiation energy stored in the stimulable phosphor as light emission (stimulated emission); photoelectrically reading out the emitted light to obtain electric signals; and reproducing the radiation image of the object from the electric signals.

Since the radiation image storage panel employed in the method hardly deteriorates upon exposure to a radiation and stimulating rays, the panel can be employed repeatedly for a long period. In practical use, after scanning the panel with stimulating rays to release radiation energy as stimulated emission therefrom (otherwise, in advance of next use of the panel), light in the wavelength region of stimulating rays for the stimulable phosphor employed in the panel or heat is usually applied to the panel so as to erase the radiation energy remaining in the panel, because the stored radiation energy cannot be fully released from the panel by scanning with the stimulating rays.

In the above-described radiation image recording and reproducing method, a radiation image can be obtained with a sufficient amount of information by applying a radiation to an object at considerably smaller dose, as compared with the case of using the conventional radiography. Accordingly, this radiation image recording and reproducing method is of great value especially when the method is used for medical diagnosis.

The radiation image storage panel employed in the radiation image recording and reproducing method has a basic structure comprising a support and a stimulable phosphor layer provided on one surface of the support. Further, a transparent film is generally provided on the free surface (surface not facing the support) of the phosphor layer to keep the phosphor layer from chemical deterioration or physical shock. Furthermore, the edge faces of the panel may be reinforced by coating them with a polymer material to enhance the mechanical strength, as described in Japanese Patent Provisional Publication No. 58(1983)-68746 (corresponding to U.S. patent application Ser. No. 434,885 and European Patent Publication No. 83470).

As described above, the radiation image storage panel is employed repeatedly in a cyclic procedure comprising steps of erasing the remaining energy from the panel, exposing the panel to a radiation, and scanning the panel with stimulating rays (that is, reading out the radiation image as stimulated emission from the panel). In the above-mentioned cyclic procedure, the panel is transferred from a step to the subsequent step through a certain transfer system and generally piled on other panels to store after one cycle is finished.

Accordingly, the radiation image storage panel employed in the radiation image recording and reproducing method is subjected to conditions quite different from those to which the intensifying screen is subjected in the conventional radiography wherein the screen is fixed in a cassette. For this reason, various troubles which never occur in the use of the conventional intensifying screen are encountered in the use of the radiation image storage panel.

For instance, both surfaces of the radiation image storage panel are sometimes damaged by physical contact such as rubbing of the front surface of the panel against the back surface of another panel, or rubbing of the front surface (or back surface) of the panel against an edge of another panel, when the panel is piled on the other panel or moved from the pile of panels to the transfer system in the repetitious use comprising transfering and piling of the panel. Particularly, the physical damage occurring on the front surface is liable to cause scattering of stimulating rays, which results in decrease of an amount of image information to be obtained as well as obscuration of the image information.

Accordingly, it is desired for a radiation image storage panel which generally has a basic structure comprising a support, a phosphor layer provided on the support and a protective film provided on the phosphor layer as described above, that the front surface thereof (namely, the suface of the protective film) is protected to the utmost from the damage occurring in the transferring or piling procedure.

SUMMARY OF THE INVENTION

Accordingly, an object of the present invention is to provide a radiation image storage panel, the front surface of which is improved in the resistance to physical deterioration such as abrasion.

The above-described object is accomplished by a radiation image storage panel of the present invention comprising a support, a phosphor layer provided on the support which comprises a binder and a stimulable phosphor dispersed therein, and a protective film provided on the phosphor layer, characterized in that said support has a surface hardness lower than that of said protective film.

The object is also accomplished by another radiation image storage panel of the present invention in which a plastic film layer is provided on the surface of the support on the side opposite to the phosphor layer-side and that said plastic film layer has a surface hardness lower than that of the protective film. This can be utilized in place of reducing the surface hardness of the support at a level lower than that of the protective film.

In the present specification, the term "front surface" of a radiation image storage panel means a free surface (surface not facing the phosphor layer) of a protective film, and the term "back surface" of the panel means a free surface (surface not facing the phosphor layer) of the support, or a free surface (surface not facing the support) of a plastic film layer in the case that the plastic film layer is provided on the support.

In the present invention, the surface hardness is determined by the scratch hardness test according to ASTM standard (ASTM D1526-58T, Brierbaum's scratch hardness), and it is represented by a value of destruction-resistance (Kg./mm$^2$) of a material, the value being obtained when a moving load to give scratching is applied onto the surface of the material.

DETAILED DESCRIPTION OF THE INVENTION

The radiation image storage panel of the present invention is improved in the resistance to physical deterioration by reducing the surface hardness of the back surface of the panel to a level lower than that of the front surface of the panel, that is, by employing a support having a surface hardness lower than that of a protective film, or by providing a plastic film layer having a surface hardness lower than that of the protective film on the support. This improvement effectively prevents the panel from damage such as abrasion which is liable to be given onto the front surface of the panel through physical contact of said panel with another panel. The physical contact is encountered when the panel is piled on another panel or transferred from the piled position, in which the front surface of the panel is liable to rub against the back surface of another panel. Accordingly, in the case that the radiation image storage panel of the present invention is used, a radiation image having a higher quality can be obtained.

Figure 1:
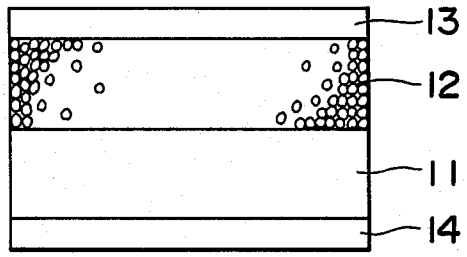
FIG. 1 is a schematic view illustrating the constitution of one embodiment of a radiation image storage panel of the present invention wherein the support, the phosphor layer, the protective film, and the plastic film having a surface hardness lower than that of the protective film are represented by the numerals 11, 12, 13 and 14, respectively.

The radiation image storage panel of the present invention having the above-mentioned preferable characteristics will be described below, in the first time, referring to one embodiment of the invention schematically illustrated in FIG. 1, that is a radiation image storage panel having a plastic film layer 14 provided on a support 11.

Examples of the material employable for the plastic film layer of the radiation image storage panel of the present invention include plastics capable of showing a relatively low surface hardness when the plastic is shaped in the form of a film, such as polypropylene, nylon (polyamide), expandable polyethylene, cellulose acetate, polyimide, cellulose triacetate, polycarbonate, polyvinylidene chloride and polyvinyl acetate.

However, the surface hardness of the film made of each plastic varies depending upon a polymerization degree of the material, molecular structure thereof, or film production conditions. Accordingly, the materials employed for the plastic film layer in the present invention and its film production conditions, or the like must be selected in the relation to the surface hardness of the employed protective film, under condition that the surface hardness of the plastic film layer is lower than that of the protective film.

The typical surface hardness of plastic films produced from the materials described above are set forth in Table 1 in terms of values measured by the scratch hardness test according to the aformentioned ASTM standard.

TABLE 1

| Film | Surface Hardness (Kg./mm$^2$) |
|---|---|
| Polypropylene | 10 |
| Nylon | 11 |
| Expanded Polyethylene | 8 |
| Cellulose Acetate | 10 |
| Polyimide | 12 |
| Cellulose Triacetate | 13 |
| Polycarbonate | 14 |
| Polyvinylidene Chloride | 5 |
| Polyvinyl Acetate | 4 |

The materials employable for the production of the plastic film layer in the present invention are by no means restricted to the above-described materials, and any other material can be employed, as far as the plastic film layer can be so produced that its surface hardness is lower than that of the protective film.

Examples of the materials employed for the protective film provided on the phosphor layer in the present invention include cellulose derivatives such as cellulose acetate and nitrocellulose, and plastics having a high transparency such as polyethylene terephthalate, polyethylene, polyamide, polymethyl methacrylate, polyvinyl butyral, polyvinyl formal, polycarbonate, and vinyl chloride-vinyl acetate copolymer.

The surface hardness of films produced from these materials is shown in Table 2.

TABLE 2

| Film | Surface Hardness (kg./mm$^2$) |
|---|---|
| Polyethylene Terephthalate | 22 |
| Polyethylene | 15 |
| Polyamide | 11 |
| Polymethyl Methacrylate | 20 |
| Polyvinyl Butyral | 17 |
| Polyvinyl Formal | 18 |
| Polycarbonate | 14 |
| Vinyl Chloride-Vinyl Acetate Copolymer | 15 |

Among the above-listed materials, the polyethylene terephthalate is preferred from the viewpoint of the transparency and the function as a protective film.

As described hereinbefore, the surface hardness of film made of each plastic varies depending upon a polymerization degree of the plastic, molecular structure thereof or film production conditions. Accordingly, the materials employable for the protective film in the present invention and its film production conditions, or the like must be selected in the relation to the surface hardness of the plastic film layer, under the condition that the protective film should serves to protect the phosphor layer and have the surface hardness higher than that of the plastic film layer.

The radiation image storage panel having such a plastic film layer provided on the surface of a support as described above can be prepared, for instance, in the following manner.

In the first place, a plastic film layer is formed on the surface of the support. The formation of the plastic film layer on the support can be done, for instance, by applying a coating solution of the above-described material in an appropriate solvent onto the surface of the support. Otherwise, the plastic film layer can be formed by fixing a previously prepared thin film made of the above-described material onto the surface of the support using an appropriate adhesive agent. Thus formed plastic layer preferably has a thickness within the range of approx. 5–500 μm.

The support material employed in the present invention can be selected from those employed in the conventional radiographic intensifying screens or those employed in the known radiation image storage panels. Examples of the support material include plastic films such as films of cellulose acetate, polyester, polyethylene terephthalate, polyamide, polyimide, cellulose triacetate and polycarbonate; metal sheets such as aluminum foil and aluminum alloy foil; ordinary papers; baryta paper; resin-coated papers; pigment papers containing titanium dioxide or the like; and papers sized with polyvinyl alcohol or the like. From the viewpoint of characteristics of a radiation image storage panel as an information recording material, a plastic film is preferably employed as the support material of the invention. The plastic film may contain a light-absorbing material such as carbon black, or may contain a light-reflecting material such as titanium dioxide. The former is appropriate for preparing a high-sharpness type radiation image storage panel, while the latter is appropriate for preparing a high-sensitivity type radiation image storage panel.

In the preparation of a known radiation image storage panel, one or more additional layers are occasionally provided between the support and the phosphor layer, so as to enhance the bonding between the support and the phosphor layer, or to improve the sensitivity of the panel or the quality of an image provided thereby. For instance, a subbing layer or an adhesive layer may be provided by coating polymer material such as gelatin over the surface of the support on the phosphor layer side. Otherwise, a light-reflecting layer or a light-absorbing layer may be provided by forming a polymer material layer containing a light-reflecting material such as titanium dioxide or a light-absorbing material such as carbon black. In the invention, one or more of these additional layers may be provided on the support.

As described in Japanese Patent Application No. 57(1982)-82431 (which corresponds to U.S. patent application Ser. No. 496,278 and the whole content of which is described in European Patent Publication No. 92241), the phosphor layer-side surface of the support (or the surface of an adhesive layer, light-reflecting layer, or light-absorbing layer in the case where such layers provided on the support) may be provided with protruded and depressed portions for enhancement of the sharpness of the image.

On the other surface of the support, a phosphor layer is provided. The phosphor layer comprises a binder and stimulable phosphor particles dispersed therein.

The stimulable phosphor particles, as described hereinbefore, give stimulated emission when excited with stimulating rays after exposure to a radiation. In the viewpoint of practical use, the stimulable phosphor is desired to give stimulated emission in the wavelength region of 300–500 nm when excited with stimulating rays in the wavelength region of 400–850 nm.

Examples of the stimulable phosphor employable in the radiation image storage panel of the present invention include:

SrS:Ce,Sm, SrS:Eu,Sm, $ThO_2$:Er, and $La_2O_2S$:Eu,Sm, as described in U.S. Pat. No. 3,859,527;

ZnS:Cu,Pb, $BaO.xAl_2O_3$:Eu, in which x is a number satisfying the condition of $0.8 \leqq x \leqq 10$, and $M^{2+}O.xSiO_2$:A, in which $M^{2+}$ is at least one divalent metal selected from the group consisting of Mg, Ca, Sr, Zn, Cd and Ba, A is at least one element selected from the group consisting of Ce, Tb, Eu, Tm, Pb, Tl, Bi and Mn, and x is a number satisfying the condition of $0.5 \leqq x \leqq 2.5$, as described in U.S. Pat. No. 4,326,078;

$(Ba_{1-x-y},Mg_x,Ca_y)FX:aEu^{2+}$, in which X is at least one element selected from the group consisting of Cl and Br, x and y are numbers satisfying the conditions of $0<x+y \leqq 0.6$, and $xy \neq 0$, and a is a number satisfying the condition of $10^{-6} \leqq a \leqq 5 \times 10^{-2}$, as described in Japanese Patent Provisional Publication No. 55(1980)-12143;

LnOX:xA, in which Ln is at least one element selected from the group consisting of La, Y, Gd and Lu, X is at least one element selected from the group consisting of Cl and Br, A is at least one element selected from the group consisting of Ce and Tb, and x is a number satisfying the condition of $0<x<0.1$, as described in the above-mentioned U.S. Pat. No. 4,236,078; and $(Ba_{1-x},M^{II}_x)FX:yA$, in which $M^{II}$ is at least one divalent metal selected from the group consisting of Mg, Ca, Sr, Zn and Cd, X is at least one element selected from the group consisting of Cl, Br and I, A is at least one element selected from the group consisting of Eu, Tb, Ce, Tm, Dy, Pr, Ho, Nd, Yb and Er, and x and y are numbers satisfying the conditions of $0 \leqq x \leqq 0.6$ and $0 \leqq y \leqq 0.2$, respectively, as described in Japanese Patent Provisional Publication No. 55(1980)-12145.

The above-described stimulable phosphors are given by no means to restrict the stimulable phosphor employable in the present invention. Any other phosphor can be also employed, provided that the phosphor gives stimulated emission when excited with stimulating rays after exposure to a radiation.

Examples of the binder to be contained in the phosphor layer include: natural polymers such as proteins (e.g. gelatin), polysaccharides (e.g. dextran) and gum arabic; and synthetic polymers such as polyvinyl butyral, polyvinyl acetate, nitrocellulose, ethylcellulose, vinylidene chloride-vinyl chloride copolymer, polymethyl methacrylate, vinyl chloride-vinyl acetate copolymer, polyurethane, cellulose acetate butyrate, polyvinyl alcohol, and linear polyester. Particularly preferred are nitrocellulose, linear polyester, and a mixture of nitrocellulose and linear polyester.

The phosphor layer can be formed on the support, for instance, by the following procedure.

In the first place, phosphor particles and a binder are added to an appropriate solvent, and then they are mixed to prepare a coating dispersion of the phosphor particles in the binder solution.

Examples of the solvent employable in the preparation of the coating dispersion include lower alcohols such as methanol, ethanol, n-propanol and n-butanol; chlorinated hydrocarbons such as methylene chloride and ethylene chloride; ketones such as acetone, methyl ethyl ketone and methyl isobutyl ketone; esters of lower alcohols with lower aliphatic acids such as methyl acetate, ethyl acetate and butyl acetate; ethers such as dioxane, ethylene glycol monoethylether and ethylene glycol monoethyl ether; and mixtures of the above-mentioned compounds.

The ratio between the binder and the phosphor in the coating dispersion may be determined according to the characteristics of the aimed radiation image storage panel and the nature of the phosphor employed. Generally, the ratio therebetween is within the range of from 1:1 to 1:100 (binder:phosphor, by weight), preferably from 1:8 to 1:40.

The coating dispersion may contain a dispersing agent to increase the dispersibility of the phosphor particles therein, and also contain a variety of additives such as a plasticizer for increasing the bonding between the binder and the phosphor particles in the phosphor layer. Examples of the dispersing agent include phthalic acid, stearic acid, caproic acid and a hydrophobic surface active agent. Examples of the plasticizer include phosphates such as triphenyl phosphate, tricresyl phosphate and diphenyl phosphate; phthalates such as diethyl phthalate and dimethoxyethyl phthalate; glycolates such as ethylphthalyl ethyl glycolate and butylphthalyl butyl glycolate; and polyesters of polyethylene glycols with aliphatic dicarboxylic acids such as polyester of triethylene glycol with adipic acid and polyester of diethylene glycol with succinic acid.

The coating dispersion containing the phosphor particles and the binder prepared as described above is applied evenly to the surface of the support to form a layer of the coating dispersion. The coating procedure can be carried out by a conventional method such as a method using a doctor blade, a roll coater or a knife coater.

After applying the coating dispersion onto the support, the coating dispersion is then heated slowly to dryness so as to complete the formation of a phosphor layer. The thickness of the phosphor layer varies depending upon the characteristics of the aimed radiation image storage panel, the nature of the phosphor, the ratio between the binder and the phosphor, etc. Generally, the thickness of the phosphor layer is within a range of from 20 μm to 1 mm, preferably from 50 to 500 μm.

The phosphor layer can be provided on the support by the methods other than that given in the above. For instance, the phosphor layer is initially prepared on a sheet (false support) such as a glass plate, metal plate or plastic sheet using the aforementioned coating dispersion and then thus prepared phosphor layer is overlaid on the genuine support by pressing or using an adhesive agent.

On the surface of the phosphor layer, a transparent protective film made of such material as aforementioned is provided to protect the phosphor layer from physical and chemical deterioration.

The protective film can be provided onto the phosphor layer by coating the surface of the phosphor layer with a solution of the aforementioned polymer material in an appropriate sovlvent. Alternatively, the protective film can be provided onto the phosphor layer by beforehand preparing a transparent thin film from the polymer, followed by placing and fixing it onto the phosphor layer with an appropriate adhesive agent. The transparent protective film preferably has a thickness within a range of approx. 3 to 20 μm.

Thus, a radiation image storage panel comprising the plastic film layer, support, phosphor layer and protective film, superposed in this order, is prepared. The plastic film layer can be also provided by applying the coating solution or fixing the plastic film with the adhesive agent onto the surface (not facing the phosphor layer) of the support after the panel comprising the support, phosphor layer and protective film is prepared.

Figure 2:
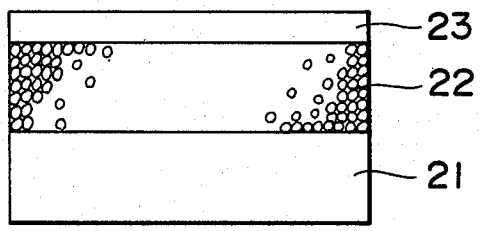
FIG. 2 is a schematic view illustrating the constitution of another embodiment of a radiation image storage panel of the present invention wherein the support (which has a surface hardness lower than that of the below-mentioned protective film), the phosphor layer, and the protective film are represented by the numerals 21, 22 and 23, respectively.

Another embodiment of the present invention schematically illustrated in FIG. 2, that is, a radiation image storage panel which comprises a support 21, a phosphor layer 22 provided on the support comprising a binder and a stimulable phosphor dispersed therein and a protective film 23 provided on the phosphor layer, and which has such requisite characteristics as that the support 21 has a surface hardness lower than that of the protective film 23, can be prepared by employing a support having the surface hardness lower than that of the protective film instead of providing the plastic film layer on the support as described above.

The support material employed in the embodiment of the present invention can be selected from those employed for the plastic film layer as mentioned above. The plastic film for the support may contain a light-absorbing material such as carbon black, or may contain a light-reflecting material such as titanium dioxide, although the obtained support necessarily has the surface hardness lower than that of the protective film and can necessarily serve as a support of the panel.

One or more additional layers can be occasionally provided between the support and the phosphor layer, such as an adhesive layer, a light-reflecting layer or a light-absorbing layer as mentioned above. Further, the phosphor layer-side surface of the support (or the surface of an adhesive layer, light-reflecting layer, or light-absorbing layer in the case where such layers are provided on the support) may be provided with protruded and depressed portions.

On the surface of the support, the phosphor layer and the transparent protective film are subsequently formed in the same manner as described above to prepare a radiation image storage panel comprising the support, phosphor layer and protective film.

For further improvement in the transferability (transportation easiness) and the resistance to physical deterioration such as abrasion of the radiation image storage panel, the panel of the present invention is preferably chamfered on the edges thereof and then covered on the edge faces thereof including the chamfered edge with a polymer material. The chamfering and covering can be carried out in the manner as described in Japanese Patent Application No. 57(1982)-87799 (corresponding to U.S. patent application Ser. No. 496,731 and European Patent Application No. 83105137.0).

The chamfering is preferably applied to the front edge (viewed along the direction in which the panel is transferred) of the panel on the support side (or plastic film layer-side in the case of providing the plastic film layer on the support) for facilitating transfer of the panel. It is more preferable to chamfer all edges of the panel on the support side for more completely preventing the front surface of the panel from damage. Furthermore, it is preferable to chamfer the edges on the protective film-side as well as on the support side, so as to further improve both the easiness for transferring the panel and the resistance to physical deterioration of the panel. The so chamfered edge may have a flat face or a curved face.

The chamfering of the edge on the support side (including the plastic film layer in the case that the support is provided) of the panel should be preferably done in a depth within the range of 1/50 to 1/1 against the thickness of the support, measured in the direction vertical to the panel. Likewise, the chamfering of the edge on the protective film-side (including the phoshor layer) of the panel should be preferably done in a depth within the range of 1/50 to 1/1 against the thickness of the phosphor layer. When the edge on the support side and the edge on the protective film-side opposite to said edge on the support side are to be chamfered, the depth of at least one chamfered space is preferably adjusted to a level of less than 1/1 (against the same as above) so that the edge chamfered on both sides might not form a sharp edge.

The radiation image storage panel chamfered as described above may be covered with a polymer material on its edge faces to reinforce the chamfered face.

The materials employable for covering the edge faces can be chosen from those generally known as polymer materials. For instance, there can be mentioned the following polyurethane and acrylic resins which are described in the aforementioned Japanese Patent Provisional Publication No. 58(1983)-68746.

Preferred polyurethane is a polymer having urethane groups (—NH—COO—) in the molecular chain. Examples of such polyurethane include a polyaddition reaction product of 4,4'-diphenylmethane diisocyanate with 2,2'-diethyl-1,3-propanediol, a polyaddition reaction product of hexamethylene diisocyanate with 2-n-butyl-2-ethyl-1,3-propanediol, a polyaddition reaction product of 4,4'-diphenylmethane diisocyanate with bisphenol A, and a polyaddition reaction product of hexamethylene diisocyanate with resorcinol.

Examples of the acrylic resin include homopolymers of acrylic acid, methyl acrylate, ethyl acrylate, butyl acrylate, methylacrylic acid and methylmethacrylic acid; and copolymers of these monomers with other monomers such as an acrylic acid-styrene copolymer and an acrylic acid-methyl methacrylate copolymer. Particularly preferred material is poly(methyl methacrylate), namely, a homopolymer of methyl methacrylate, and it is preferred to employ an acrylic resin having a polymerization degree ranging from $1\times10^4$ to $5\times10^5$.

Further, a mixture of the above-described polyurethane or acrylic resins (especially acrylic resins) with other various polymer materials (polymers for blending) can be also employed for edge-reinforcing of the edge faces of panel. Most preferred polymer for blending is a vinyl chloride-vinyl acetate copolymer. A representative example of the blended resin is a mixture of an acrylic resin and a vinyl chloride-vinyl acetate copolymer in the ratio of 1:1 to 4:1 by weight, the latter containing vinyl chloride in the ratio of 70–90% and having the polymerization degree of 400–800.

The present invention will be illustrated by the following examples, but these examples by no means restrict the invention.

EXAMPLE 1

To a mixture of an europium activated barium fluorobromide stimulable phosphor ($BaFBr:Eu^{2+}$) and a linear polyester resin were added successively methyl ethyl ketone and nitrocellulose (nitrification degree: 11.5%), to prepare a dispersion containing the phosphor particles. Subsequently, tricresyl phosphate, n-butanol and methyl ethyl ketone were added to the resulting dispersion. The mixture was sufficiently stirred by means of a propeller agitator to obtain a homogeneous coating dispersion having a viscosity of 25–35 PS (at 25° C.).

The coating dispersion was applied to an expanded polyethylene film (support, surface hardness: 8 Kg./mm$^2$, thickness: 250 μm) placed horizontally on a glass plate. The application of the coating dispersion was carried out using a doctor blade. The support having a layer of the coating dispersion was then placed in an oven and heated at a temperature gradually rising from 25° to 100° C. Thus, a phosphor layer having thickness of 300 μm was formed on the support.

On the phosphor layer was placed a polyethylene terephthalate transparent film (surface hardness: 22 Kg./mm$^2$, thickness: 12 μm; provided with a polyester adhesive layer on one surface) to bond the film and the phosphor layer with the adhesive layer, to form a transparent protective film thereon.

Thus, a radiation image storage panel consisting essentially of a support, a phosphor layer and a protective film was prepared.

COMPARISON EXAMPLE 1

A radiation image storage panel consisting essentially of a support, a phosphor layer and a protective film was prepared in the same manner as described in Example 1, except that a polyethylene terephthalate film (surface hardness: 22 Kg./mm$^2$) having the same thickness was employed as the support in place of the expanded polyethylene film.

The so prepared radiation image storage panels were evaluated on the resistance to physical deterioration (abrasive damage) by observing abrasion produced under the rubbing procedure described below.

The radiation image storage panel was cut to give a rectangular test strip (25.2 cm×30.3 cm), and the test strip was placed on a sheet made of the same material as employed for the protective film of the panel (namely, the same polyethylene terephthalate film (sheet) as in the present examples) in such a manner that the support of the test strip faced the sheet. The test strip was then rubbed against the sheet 1000 times along a rubbing path of 10 cm. After the rubbing was complete, the surface of the polyethylene terephthalate sheet was visiually evaluated on abrasion, since this sheet can be resonably assumed as a model of the protective film of the panel.

The results of the evaluation on the resistance to abrasive damage of the radiation image storage panels were marked by the following three levels of A, B and C.

A: Abrasion was hardly observed.

B: A little abrasion was observed, but the abrasion was such a low level that no problem was brought about to the panel in practical use.

C: Abrasion was apparently noted.

The results are set forth in Table 3.

TABLE 3

| | Support (Surface Hardness; Kg./mm$^2$) | Resistance to Abrasion |
|---|---|---|
| Example 1 | Expanded Polyethylene (8 Kg./mm$^2$) | A |
| Com. Example 1 | Polyethylene Terephthalate (22 Kg./mm$^2$) | C |

EXAMPLE 2

A radiation image storage panel consisting essentially of a support, a phosphor layer and a protective film was prepared in the same manner as described in Example 1, except that a polyethylene terephthalate film (thickness: 250 μm) was employed as the support in place of the expanded polyethylene film.

Then, a polypropylene film (plastic film layer, surface hardness: 10 Kg./mm$^2$, thickness: 25 μm) was fixed to the surface of the support not facing the phosphor layer with an adhesive agent, to form a plastic film layer on the support.

Thus, a radiation image storage panel consisting essentially of a plastic film layer, a support, a phosphor layer and a protective film was prepared.

The so prepared radiation image storage panel was evaluated on the resistance to physical deterioration (abrasive damage) in the same manner as described above.

The results are set forth in Table 4.

TABLE 4

| | Plastic Film Layer (Surface Hardness; Kg./mm$^2$) | Resistance to Abrasion |
|---|---|---|
| Example 2 | Polypropylene (10 Kg./mm$^2$) | A |
| Com. Example 1 | Polyethylene Terephthalate (22 Kg./mm$^2$) | C |

We claim:

1. A radiation image storage panel comprising a support, a phosphor layer provided on the support which comprises a binder and a stimulable phosphor dispersed therein, and a protective film provided on the phosphor layer, characterized in that said support has a surface hardness lower than that of said protective film.

2. The radiation image storage panel as claimed in claim 1, in which said support is made of a plastic film.

3. The radiation image storage panel as claimed in claim 1, in which said protective film is made of a polyethylene terephthalate film.

4. The radiation image storage panel as claimed in any one of claims 1 through 3, in which at least one edge on the support side of said panel is chamfered and edge faces including the chamfered edge are covered with a polymer material.

5. A radiation image storage panel comprising a support, a phosphor layer provided on the support which comprising a binder and a stimulable phosphor dispersed therein, and a protective film provided on the phosphor layer, characterized in that a plastic film layer is provided on the surface of said support on the side opposite to the phosphor layer-side and that said plastic film layer has a surface hardness lower than that of said protective film.

6. The radiation image storage panel as claimed in claim 5, in which said protective film is made of a polyethylene terephthalate film.

7. The radiation image storage panel as claimed in claim 5 or claim 6, in which at least one edge on the support side of said panel is chamfered and edge faces including the chamfered edge are covered with a polymer material.

* * * * *